US005904307A

United States Patent [19]

Prairie et al.

[11] Patent Number: 5,904,307

[45] Date of Patent: May 18, 1999

[54] PULVERIZER APPARATUS WITH HORIZONTAL AXIS PIVOT SCRAPER

[75] Inventors: Robert S. Prairie, Vernon, Conn.; Ronald P. Przybycien, Holyoke, Mass.

[73] Assignee: Combustion Engineering, Inc., Windsor, Conn.

[21] Appl. No.: 09/062,109

[22] Filed: Apr. 17, 1998

[51] Int. Cl.[6] ..... B02C 15/00

[52] U.S. Cl. ..... 241/117; 241/119; 241/166; 241/167

[58] Field of Search ..... 241/117, 119, 241/166, 167, 118

[56] References Cited

U.S. PATENT DOCUMENTS

| | | | |
|---|---|---|---|
| 2,461,176 | 2/1949 | Piper | 241/124 |
| 2,626,758 | 1/1953 | Scarlett | 241/124 |
| 2,641,387 | 6/1953 | Christensen | 241/119 X |
| 2,818,219 | 12/1957 | Straight | 241/119 |
| 3,556,419 | 1/1971 | Frangquist et al. | 241/61 |
| 4,860,962 | 8/1989 | Kiefer et al. | 241/117 |
| 5,480,099 | 1/1996 | Bunton | 241/119 |

*Primary Examiner*—John M. Husar
*Attorney, Agent, or Firm*—Robert S. Smith

[57] ABSTRACT

A scraper assembly for use with an associated coal pulverizer or as part of a coal pulverizer having a vertical axis with a central hub that rotates during normal operation of the pulverizer. The scraper assembly includes a bracket dimensioned and configured for attachment to the hub of the coal pulverizer that rotates in the normal operation of the coal pulverizer. The apparatus also includes a shaft extending from the bracket. The shaft is substantially horizontal and the apparatus also includes a scraping element pivotally mounted on the shaft. A torsion spring biases the scraping element with respect to the shaft. In some forms of the invention the scraping element comprises a first and second journals engaging the shaft at axially spaced points and the scraping element further includes first and second arms extending radially away from the shaft that are respectively fixed to the first and second journals. The apparatus may further include a first plate shaped member carried on the first and second arms and a second plate shaped member removably attached to the first plate shaped member.

18 Claims, 4 Drawing Sheets

PULVERIZER APPARATUS WITH HORIZONTAL AXIS PIVOT SCRAPER

BACKGROUND OF THE INVENTION

The invention relates to pulverizers of the type that are used in pulverized coal fired steam generating systems. More particularly, the invention relates to apparatus that scrapes accumulated substances from the underbowl of a bowl mill.

Pulverized coal firing is favored over other methods of burning coal because pulverized coal burns like gas and, therefore, fires are easily lighted and controlled.

Pulverizers, also referred to as mills, are used to grind or comminute the fuel. The present invention has primary application to bowl pulverizers or mills. Although the present invention will be described with respect a bowl type ring roll pulverizer. Those skilled in the art will recognize that the invention may be used in other bowl type mills as well.

In the operation of a pulverizer coal enters the center of the pulverizer and through a center feed pipe. The coal is pulled onto a rotating bowl which has a replaceable wear surface. Centrifugal force causes the coal to move outward from the center and under three journal assemblies, where it is crushed by large rolls. The partially pulverized coal passes over the rim of the bowl and is it entrained by a rising hot air stream. Pyrites and tramp iron that enter the mill with the coal follow the same path as the coal until they pass over the rim of the bowl. Because these materials are more dense than coal, they are not carried any further upward by the air stream and fall into an underbowl. In addition to pyrites and tramp iron there may be other heavy foreign materials that may be found in the coal that will also fall into the underbowl.

These materials are both very abrasive and erosive. Removal of these materials from the underbowl requires the use of a scraper to mechanically push the materials toward an outlet chute. The abrasion and errosion caused by these materials is prejudicial to the service life of the scraper apparatus.

The hostile environment in which the scraper mechanism must operate will be more apparent by considering both the nature of the materials that pass through the pulverizer as well as the quality of material that flows through the pulverizer. A typical pulverizer has a capacity of up to 200,000 pounds of coal per hour.

Prior art scrapers have included a generally planar scraping element carried on a vertical axis. Centrifugal forces urge the scraping element to a generally radial position. A central body carries the vertical axes of the scraping elements. As the central body rotates the scraping elements are urged by centrifugal forces to generally radial positions about the underbowl. If a large object falls into the underbowl the scraping element can move from the radial position upon impact with the large object and then return to the radial position after passing the large object.

It is believed that the vertical axis of the prior art scraper inherently positions a part of the bearing surface in close proximity to severely hostile abrasive and erosive environment. More particularly, the lower extremity of the vertical axis inherently must be very close to a hostile environment that it is prejudicial to the bearing.

Another concern with the prior art scraper assembly is that it requires installation of a complete assembly to repair worn parts.

In some cases wear of the vertical axis and journal bearing cooperating with the axis may allow the generally planar scraper element to droop so that the radial extremity of scraper element contacts the surface of the bowl and causes wear. Such constructions have been satisfactory for many installations. However, in some installations the materials found within a particular coal may be more abrasive and more erosive than in other coals from other parts of the world.

Another concern is that heavy assemblies are more difficult to install.

SUMMARY OF THE INVENTION

It is an object of the present invention to provide a scraper apparatus that will have a longer service life.

It is another object of the invention to provide a scraper apparatus that will more precisely position the scraper element to better clear debris from the underbowl.

It is another object of the invention is to provide apparatus that can be repaired without replacing an entire assembly. In other words, it is an object of the invention to provide a construction that can be repaired faster, with less labor and at less expense because in and not necessary to replace the entire assembly to complete the repair.

It is another object of the invention to provide apparatus which may be retrofitted easily on existing pulverizer apparatus.

Still another object of the invention is to provide apparatus which includes discrete portions that are most vulnerable to wear during the operating life and which are constructed so as to be readily replaced.

Yet another object of the invention is to provide a construction in which the bearing surface for the scraper element is spaced further away from the hostile environment than in the prior art construction.

One more object of the invention is to reduce the weight of the elements that must periodically be replaced so that the replacement will be easier.

It has now been found that these and other objects of the invention may be attained in a scraper assembly for use with an associated coal pulverizer having a vertical axis with a central hub that rotates during normal operation of the pulverizer which includes a bracket dimensioned and configured for attachment to the hub of the associated coal pulverizer that rotates in the normal operation of the associated coal pulverizer. The apparatus also includes a shaft extending from the bracket. The shaft is substantially horizontal and the apparatus also includes a scraping element pivotally mounted on the shaft; and means for biasing the scraping element with respect to the shaft.

In some forms of the invention the scraping element comprises a first and second journals engaging the shaft at axially spaced points and the scraping element further includes first and second arms extending radially away from the shaft that are respectively fixed to the first and second journals. The apparatus may further include a first plate shaped member carried on the first and second arms and a second plate shaped member removably attached to the first plate shaped member.

The means for biasing may include a spring which may be a torsion spring. Some forms of the apparatus will include means securing a first axial extremity of the torsion spring to the shaft and means securing a second axial extremity of the torsion spring to the first journal. The torsion spring may have a cylindrical shape that is coaxial with the shaft.

The invention also includes a coal pulverizer apparatus which includes means for pulverizing coal including a housing having a top and having an outlet at the top for discharge of pulverized coal and air. The means includes a bowl and a plurality of rolls and means for causing relative motion between the bowl and the plurality of rolls and a hub. A portion of the housing receives materials separated from pure coal and the apparatus includes a scraper assembly which includes a bracket dimensioned and configured for attachment to the hub, a shaft extending from the bracket that is substantially horizontal and a scraping element pivotally mounted on the shaft; and means for biasing the scraping element with respect to the shaft.

In some forms of the invention the scraping element comprise first and second journals engaging the shaft at axially spaced points, the scraping element further includes first and second arms extending radially away from the shaft, the first and second all arms are respectively fixed to the first and second journals and the apparatus further includes a first plate shaped member carried on the first and second arms.

In some forms of the invention the apparatus further includes a second plate shaped member removably attached to the first plate shaped member and the means for biasing includes a spring which may be a torsion spring. The apparatus may also include means securing a first axial extremity of the torsion spring to the shaft and means securing a second axial extremity of the torsion spring to the first journal. The torsion spring may have a cylindrical shape and the spring may be coaxial with the shaft.

BRIEF DESCRIPTION OF THE DRAWINGS

The invention will be better understood by reference to the accompanying drawing in which.

DESCRIPTION OF THE PREFERRED EMBODIMENT

Figure 1:
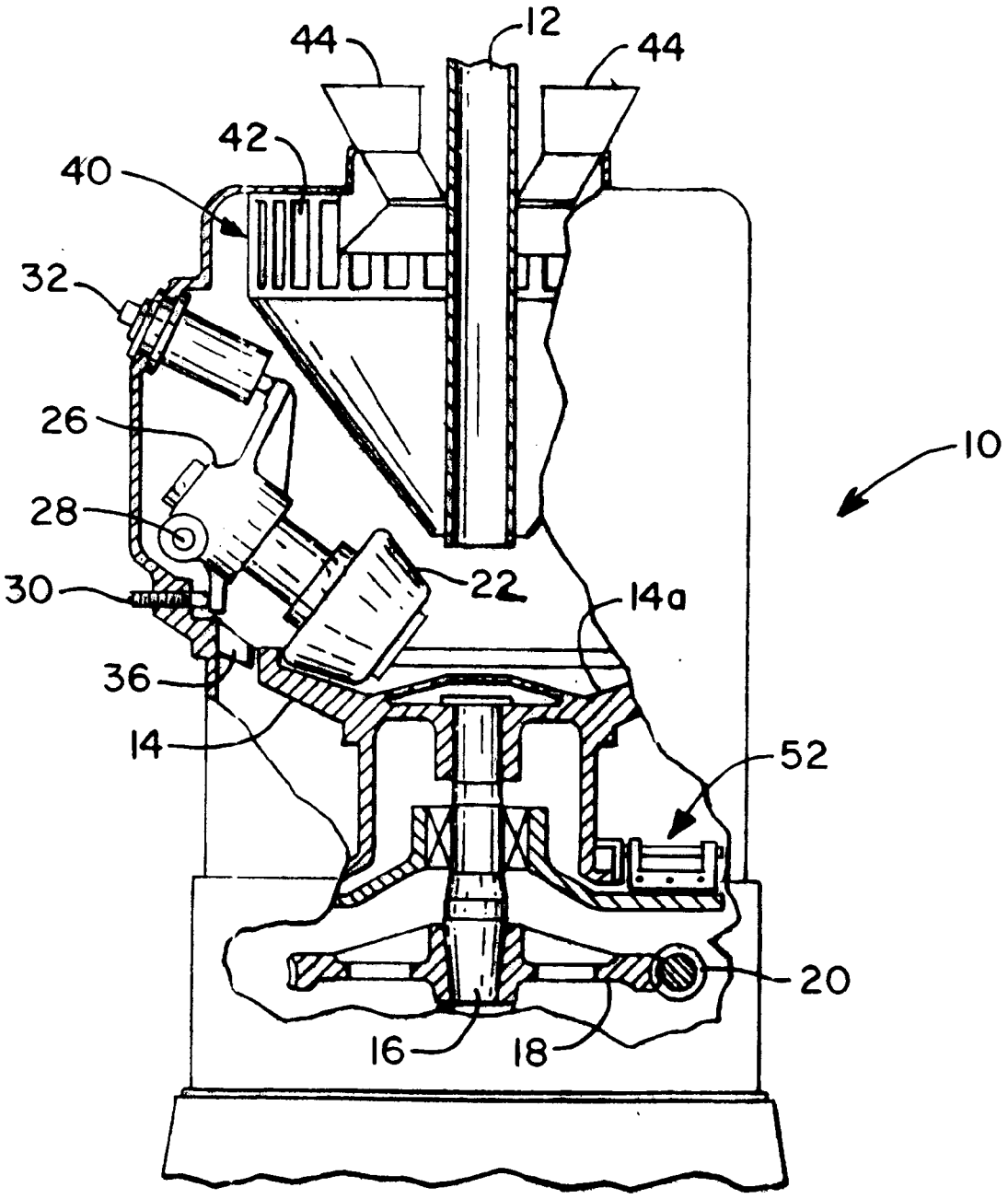
FIG. 1 is an elevational view, partially broken away and partially in section of a pulverizer incorporating the scraper assembly in accordance with one form of the present invention.
Figure 2:
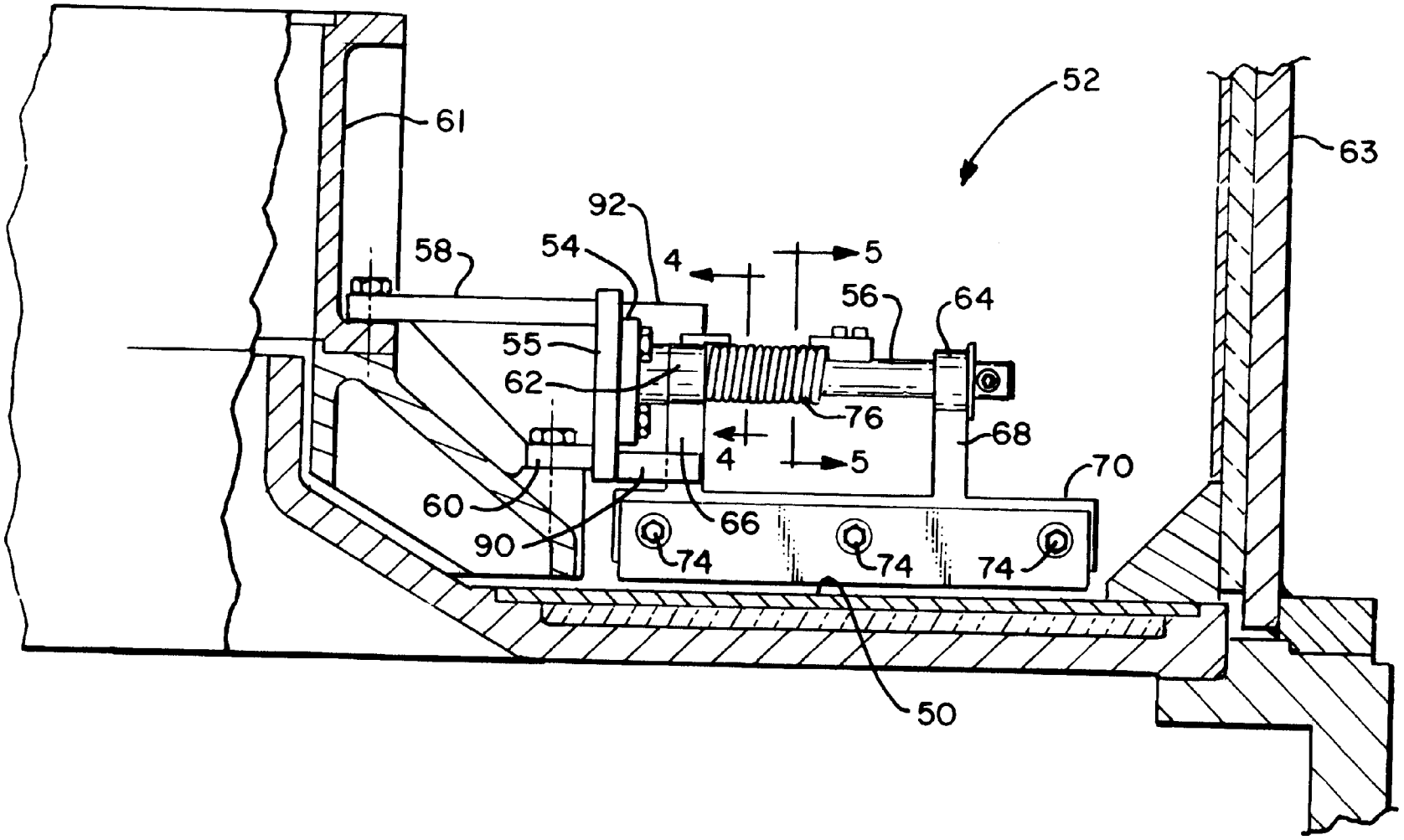
FIG. 2 is a fragmentary, elevational, more detailed view of the scraper assembly illustrated in FIG. 1.
Figure 3:
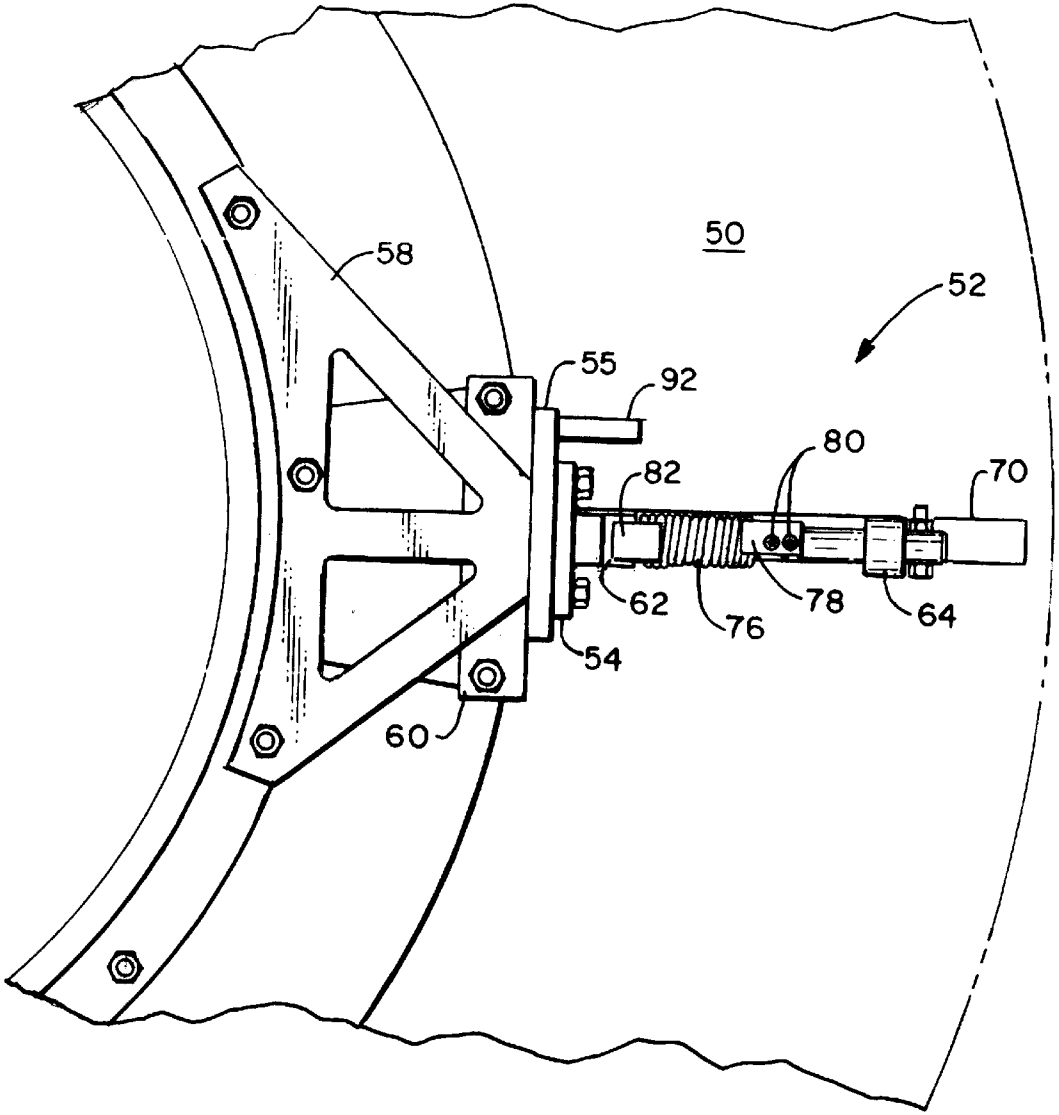
FIG. 3 is a plan view of the apparatus shown in FIG. 2.
Figure 4:
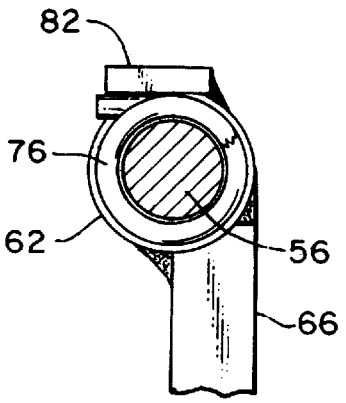
FIG. 4 is a fragmentary sectional view taken along the line 4—4 of FIG. 2.
Figure 5:
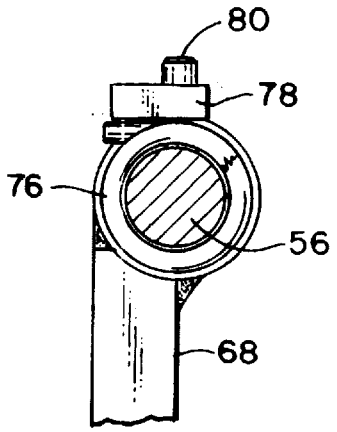
FIG. 5 is a fragmentary sectional view taken along the line 5—5 of FIG. 2.
Figure 6:
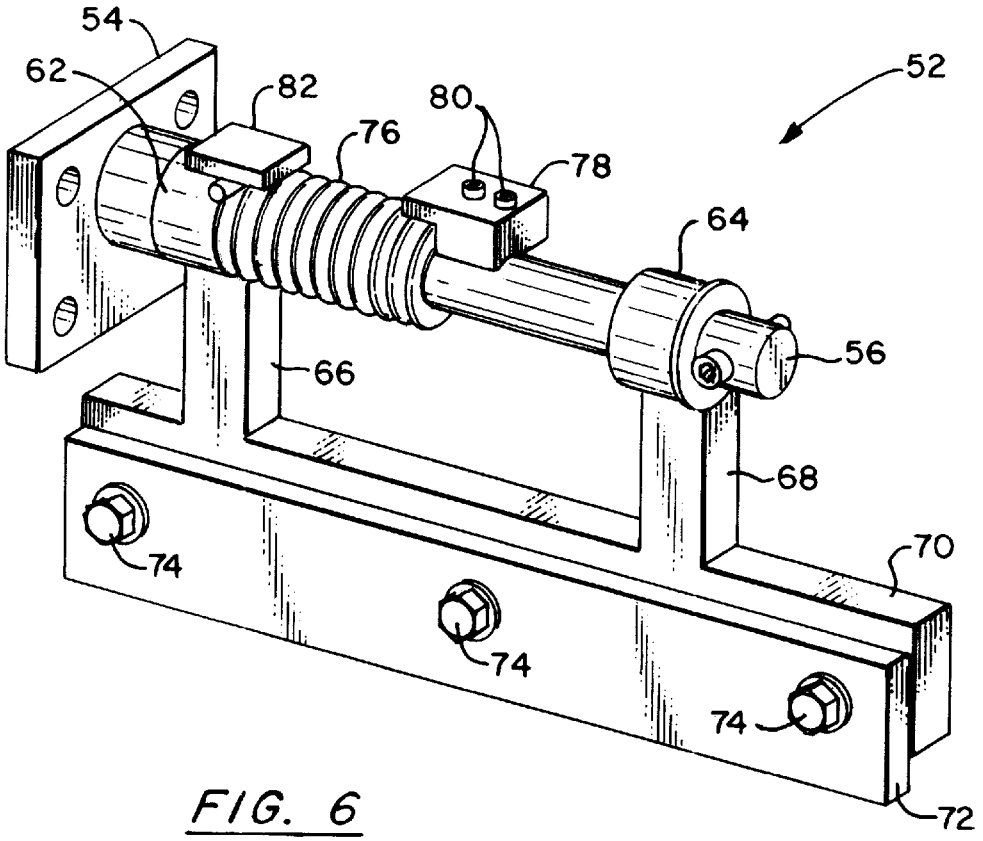
FIG. 6 is a perspective view of the scraper assembly illustrated in FIG. 1.

Referring now to FIG. 1, there is shown a pulverizer 10 having an inlet 12 through which the coal to be pulverized is fed. The coal falls into a bowl 14 that is fixed to a vertical shaft 16. A worm gear 18 is fixed to the shaft 16. A worm 20 is driven by a motor (not shown). Accordingly, the motor drives the worm 20 to drive the worm gear 18 to turn the shaft 16 and thus turn the bowl 14. (Although the description herein refers to a worm gear, it will be understood by those skilled in the art that other gear systems may be used without departing from the present invention.)

The upper face of the bowl 14 is generally dish shaped. More particularly, the upper face includes a surface 14*a* that is dimensioned and configured for cooperation with a grinding roll 22. The grinding roll 22 has a truncated conical form.

The grinding roll 22 is mounted for rotation on a shaft 24 that is carried on a journal assembly 26. The journal assembly 26 is mounted for pivotal motion about an axle 28. An adjustable stop 30 cooperates with a finger of the journal assembly 26. More particularly, the stop 30 allows adjustment to provide clearance between the grinding roll 22 and the face 14*a*.

The journal assembly 26 is biased by a spring assembly 32 so that it rotates about the axle 28 and abuts the stock 30. Those skilled in the art will recognize that ordinarily some clearance is desired intermediate the grinding roll 42 and the face 14*a*.

In operation, hot air is fed into the pulverizer 10 beneath the bowl 14. That air is directed past the vanes 36 in the region around the bowl 14. The hot air flows past the vanes 36 into the grinding area above the bowl 14. The hot air flows upwardly around the truncated cone shaped classifier assembly 40. The classifier assembly 40 includes a plurality of openings 42 at the upper part thereof. Finely ground coal is carried by the hot air from the area above the bowl 14 through the openings 42 and out the exits 44, 44. Particles that are not as finely ground will fall, due to the effects of gravity, back down through the classifier assembly 40 and onto the face 14*a* of the bowl 14 where they will be ground further until the particles are more finely ground.

Although only one such grinding roll 22, shaft 24, and journal assembly 26 is shown in FIG. 1, it will be understood by those skilled in the art that ordinarily each pulverizer 10 of this general type will have three identical grinding rolls 22. Each of the grinding rolls 22 is carried on a shaft 24 that is carried in a journal assembly 26. Each of the three journal assemblies 26 is pivoted on an axle 28 and each is biased into position by a spring assembly 32. (Although the description herein refers to a spring bias, it will be understood by those skilled in the art that a hydraulic bias may be used without departing from the present invention.)

Pyrites and tramp iron mixed in with the coal initially are heavier than pure coal and will pass over the rim of the bowl 14 and onto the upper face 50 of the underbowl. The scraper assembly 52 in accordance with a preferred form of the present invention is provided to dislodge pyrites and tramp iron that accumulate on the face 50 of the underbowl and then through an exit chute (not shown).

As best seen in FIGS. 2–6, the scraper assembly 52 is disposed intermediate the mill hub 61 and the mill side 63. (Although only one scraper assembly 52 is shown in the drawing it will be understood that a typical mill will have two such scraper assemblies.) The scraper assembly 52 includes a base plate 54 to which is fixed a horizontal shaft 56. The base plate 54 is mounted on a mounting plate 55 which is in turn mounted on a first generally triangular plate 58 and a second mounting plate 60 secured to the hub 61 of the pulverizer 10. It will the understood that the hub 61 rotates during normal operation of the mill 10.

Cooperating with the horizontal shaft 56 are first and second journals 62, 64. The first and second journals 62, 64 are dimensioned and configured to allow free rotation about the horizontal shaft 56. Fixed respectively to the journals 62, 64 are elongated arms 66, 68. The elongated arms 66, 68 are each fixed to a plate 70 that extends radially across the upper face 50 all of the underbowl. Those skilled in the art will recognize that the arms 66, 68 and the plate 70 may be fabricated from a single piece of metal even though for description purposes they are described as discrete elements which are joined together. Mounted on the plate 70 is a replaceable wiper 72. It will be understood that the wiper 72 contacts the surface 50 of the underbowl and thus is subject to considerably more wear than other structural parts of the scraper assembly 52. The wiper 72 is secured to the plate 70 by means of bolts 74,74,74. Thus, the wiper 72 may be easily replaced as wear occurs as part of the normal operation of the apparatus.

The wiper 72 is biased into the vertical position shown in the drawing by a torsion spring 76. The torsion spring 76 has one end thereof secured to the shaft 56 by a stepped plate 78 secured to the shaft 56 by two set screws 80, 80. The opposite axial extremity of the torsion spring 76 is secured to the journal 62 by a planar plate 82 that is welded to both the torsion spring 76 and the journal 62. The torsion spring 76 allows movement of the plate 70 and the wiper 72 if a large object contacts the wiper 72.

The apparatus in accordance with the invention also includes stop members 90, 92 that limit the total travel of the assembly that includes the first and second journals 62, 64; elongated arms 66, 68; plate 70 and replaceable wiper 72. More particularly, the stop members limit total travel to 90 degrees. The stop 90 (best seen in FIG. 2) limits movement past a vertical plane. The stop 92 (best seen in FIGS. 2 and 3) limits movement past a horizontal plane.

It will thus be seen that the apparatus in accordance with the present invention offers enhanced operation and service life, is easier to install and maintain and can be installed as a replacement with little or no rework of existing parts. The apparatus in accordance with the invention over avoids the use of a vertically mounted bushing that tends to wear and and allow the scraper to droop and touch directly on the pulverizer floor liner and cause excessive wear. The structure in accordance with the present invention moves the pivot away from the floor area to a horizontal position spaced away from the bottom of the mill.

This provides better support for the assembly and allows the scraper to do a better job clearing debris from the mill bottom. The torsion spring 76 provides enough resistance to remove debris from the mill bottom while still allowing the arm to fold back over larger, immovable objects so that neither the assembly nor the rest of the mill is damaged by such materials.

In addition, worn or broken complements will ordinarily require replacement. For example, the replaceable wiper or wear plate 72 mounted on the plate 70 can be replaced without the need for other elements being replaced. The use of smaller and lighter replaceable elements is also advantageous. The smaller and lighter elements are easier to handle and can be quickly replaced on an as needed basis. Thus, the scraper assembly 52 is easier to maintain.

The invention has been described with respect to its preferred embodiment. Persons skilled in the art of such devices may upon exposure to the teachings herein conceive other variations such the relations are deemed to be encompassed by the disclosure, the invention being delimited only by the following claims.

We claim:

1. A scraper assembly for use with an associated coal pulverizer having a vertical axis with a central hub that rotates during normal operation of the pulverizer which comprises:

a bracket dimensioned and configured for attachment to the hub of the associated coal pulverizer that rotates in the normal operation of the associated coal pulverizer;

a shaft extending from said bracket, said shaft being substantially horizontal;

a scraping element pivotally mounted on said shaft; and means for biasing said scraping element with respect to said shaft;

said scraping element comprises a first and second journals engaging said shaft at axially spaced points.

2. The apparatus as described in the claim 1 wherein:

said scraping element further includes first and second arms extending radially away from said shaft, said first and second arms being respectively fixed to the said the first and second journals.

3. The apparatus as described in claim 2 wherein:

the apparatus further includes a first plate shaped member carried on said first and second arms.

4. The apparatus as described in claim 3 wherein:

the apparatus further includes a second plate shaped member removably attached to said first plate shaped member.

5. The apparatus as described in claim 4 wherein:

said means for biasing includes a spring.

6. The apparatus as described and claim 5 wherein:

said means for biasing is a torsion spring.

7. The apparatus as described in claim 6 further including:

means securing a first axial extremity of said torsion spring to the said shaft.

8. The apparatus as described in claim 7 further including:

means securing a second axial extremity of said torsion spring to said first journal.

9. The apparatus as described in claim 8 wherein:

said torsion spring has a cylindrical shape and said spring is coaxial with said shaft.

10. The apparatus as described in claim 8 wherein:

said torsion spring has a cylindrical shape and said spring is coaxial with said shaft.

11. The apparatus as described and claim 6 wherein:

said means for biasing is a torsion spring.

12. The apparatus as described in claim 11 further including:

means securing a first axial extremity of said torsion spring to the said shaft.

13. The apparatus as described in claim 12 further including:

means securing a second axial extremity of said torsion spring to said first journal.

14. A coal pulverizer apparatus which comprises:

means for pulverizing coal including a housing having a top and having an outlet at the top for discharge of pulverized coal and air, said means including a bowl and a plurality of rolls, said apparatus including means for causing relative motion between said bowl and said plurality of rolls, said means for causing relative motion including a hub;

a portion of said housing receiving materials separated from pure coal; and a scraper assembly which includes a bracket dimensioned and configured for attachment to said hub, a shaft extending from said bracket, said shaft being substantially horizontal; a scraping element pivotally mounted on said shaft; and means for biasing said scraping element with respect to said shaft;

said scraping element comprises a first and second journals engaging said shaft at axially spaced points.

15. The apparatus as described in the claim 14 wherein:

said scraping element further includes first and second arms extending radially away from said shaft, said first and second all arms being respectively fixed to the said the first and second journals.

16. The apparatus as described in claim 15 wherein:

the apparatus further includes a first plate shaped member carried on said first and second arms.

17. The apparatus as described in claim 16 wherein:

the apparatus further includes a second plate shaped member removably attached to said first plate shaped member.

18. The apparatus as described in claim 17 wherein:

said means for biasing includes a spring.

* * * * *